US008056739B2

(12) United States Patent
Hopkins

(10) Patent No.: US 8,056,739 B2
(45) Date of Patent: Nov. 15, 2011

(54) DISPLAY MOUNTING SYSTEM

(76) Inventor: John Hopkins, Chipping Norton (AU)

( * ) Notice: Subject to any disclaimer, the term of this patent is extended or adjusted under 35 U.S.C. 154(b) by 229 days.

(21) Appl. No.: 11/503,374

(22) Filed: Aug. 11, 2006

(65) Prior Publication Data

US 2007/0079561 A1 Apr. 12, 2007

(30) Foreign Application Priority Data

Aug. 12, 2005 (AU) ..... 2005203620

(51) Int. Cl.
*A47F 5/08* (2006.01)

(52) U.S. Cl. ..... 211/94.01; 52/36.5; 52/36.6; 52/592.1; 248/220.21; 248/223.41

(58) Field of Classification Search ..... 211/86.01, 211/87.01, 94.01, 106, 50, 103, 107, 189, 211/190, 207; 248/220.21, 220.31, 223.41, 248/225.21, 225.11, 222.51, 222.52; 52/36.5, 52/36.6, 506.08, 512, 592.1, 710; D25/123; 108/152

See application file for complete search history.

(56) References Cited

U.S. PATENT DOCUMENTS 459,844 A * 9/1891 Thomas ..... 182/92
576,569 A * 2/1897 Gemmer ..... 52/592.1
813,816 A * 2/1906 McVey ..... 256/50
1,281,416 A * 10/1918 Pratt ..... 52/710
1,921,261 A * 8/1933 Potter ..... 296/92
3,085,367 A * 4/1963 De Ridder et. al. ..... 52/538
3,100,556 A * 8/1963 De Ridder ..... 52/588.1
3,235,218 A * 2/1966 Graham ..... 248/223.41
3,264,792 A * 8/1966 Drazdik et. al. ..... 52/508
3,352,428 A * 11/1967 Sak et. al. ..... 211/106.01
3,532,317 A * 10/1970 Adler ..... 248/223.31
3,555,762 A * 1/1971 Costanzo, Jr. ..... 52/588.1
4,099,358 A * 7/1978 Compaan ..... 52/588.1
4,100,710 A * 7/1978 Kowallik ..... 52/309.9
4,154,421 A * 5/1979 Suvitie ..... 248/327
4,236,366 A * 12/1980 Rijnders ..... 52/580
4,257,492 A * 3/1981 Rasada et al. ..... 182/206
4,299,070 A * 11/1981 Oltmanns et al. ..... 52/309.11
4,323,163 A * 4/1982 Johns ..... 211/189
4,420,087 A * 12/1983 Johns ..... 211/189
4,450,970 A * 5/1984 Shepherd ..... 211/189
4,531,331 A * 7/1985 Itagaki ..... 52/38
4,572,381 A * 2/1986 Breakey et al. ..... 211/94.01
4,603,068 A * 7/1986 Hunter ..... 428/54
4,607,753 A * 8/1986 Radek ..... 211/94.01
4,632,260 A * 12/1986 Hart et al. ..... 211/189
4,672,789 A * 6/1987 Fortier ..... 52/520
4,674,240 A * 6/1987 Strausheim ..... 52/36.4
4,750,624 A * 6/1988 Baron ..... 211/87.01
4,805,783 A * 2/1989 Mayer ..... 211/94.01
4,809,479 A * 3/1989 Tierno et al. ..... 52/588.1
4,825,601 A * 5/1989 Halverson ..... 52/36.4

(Continued)

FOREIGN PATENT DOCUMENTS

AU 2004201505 A1 10/2004

(Continued)

*Primary Examiner* — Darnell Jayne
*Assistant Examiner* — Joshua Rodden
(74) *Attorney, Agent, or Firm* — Molins & Co

(57) ABSTRACT

A system for installation of multiple panels for shelving and the like, wherein the geometry of the junction between panels provides a cavity adapted to receive the anchoring portion of shelf support brackets, or the like.

10 Claims, 18 Drawing Sheets

U.S. PATENT DOCUMENTS

| | | | | | |
|---|---|---|---|---|---|
| 4,852,213 | A | * | 8/1989 | Shewchuk | 16/266 |
| 4,891,897 | A | * | 1/1990 | Gieske et al. | 40/618 |
| 4,936,078 | A | * | 6/1990 | Porter | 52/592.1 |
| 4,944,416 | A | * | 7/1990 | Petersen et al. | 52/36.5 |
| 4,961,295 | A | * | 10/1990 | Kosch et al. | 52/36.5 |
| 4,998,304 | A | * | 3/1991 | Sauter et al. | 4/559 |
| 5,125,518 | A | * | 6/1992 | Ward | 211/87.01 |
| 5,138,803 | A | * | 8/1992 | Grossen | 52/36.4 |
| 5,170,605 | A | * | 12/1992 | Huddle | 52/588.1 |
| 5,337,903 | A | * | 8/1994 | Wolcovitch et al. | 211/85.1 |
| 5,409,120 | A | * | 4/1995 | Miller et al. | 211/85.26 |
| 5,412,912 | A | * | 5/1995 | Alves | 52/36.5 |
| 5,595,038 | A | * | 1/1997 | Prestenback | 52/592.1 |
| 5,647,184 | A | * | 7/1997 | Davis | 52/592.1 |
| 5,791,093 | A | * | 8/1998 | Diamond | 52/36.5 |
| 5,819,490 | A | * | 10/1998 | Current | 52/588.1 |
| 5,819,491 | A | * | 10/1998 | Davis | 52/592.1 |
| D404,148 | S | * | 1/1999 | Laskowski et al. | D25/123 |
| 5,857,578 | A | * | 1/1999 | Fishman | 211/189 |
| 5,899,344 | A | * | 5/1999 | Current et al. | 211/94.01 |
| 5,941,026 | A | * | 8/1999 | Eisenreich et al. | 52/36.5 |
| 6,006,486 | A | * | 12/1999 | Moriau et al. | 52/589.1 |
| 6,131,355 | A | * | 10/2000 | Groh et al. | 52/592.1 |
| 6,164,467 | A | * | 12/2000 | DePottey et al. | 211/189 |
| 6,216,409 | B1 | * | 4/2001 | Roy et al. | 52/589.1 |
| 6,311,955 | B1 | * | 11/2001 | McGarry et al. | 256/24 |
| 6,325,223 | B1 | * | 12/2001 | Hannen | 211/87.01 |
| 6,349,507 | B1 | * | 2/2002 | Muellerleile | 52/36.5 |
| 6,421,961 | B1 | * | 7/2002 | Mallozzi | 52/36.5 |
| 6,564,952 | B1 | * | 5/2003 | Suttles | 211/187 |
| D482,802 | S | * | 11/2003 | Yates, Jr. | D25/121 |
| 7,007,433 | B2 | * | 3/2006 | Boyer | 52/309.9 |
| 7,086,542 | B2 | * | 8/2006 | Tomonari et al. | 211/94.01 |
| 7,093,399 | B2 | * | 8/2006 | Thiers et al. | 52/592.1 |
| 7,322,157 | B2 | * | 1/2008 | Hang | 52/506.08 |
| 7,464,511 | B2 | * | 12/2008 | Kosch | 52/520 |
| 7,647,743 | B2 | * | 1/2010 | Moriau et al. | 52/745.19 |
| 7,694,484 | B2 | * | 4/2010 | Lucas et al. | 52/582.1 |
| 2004/0111980 | A1 | * | 6/2004 | Kosch | 52/36.5 |
| 2006/0049323 | A1 | * | 3/2006 | Anzai | 248/250 |
| 2007/0079561 | A1 | * | 4/2007 | Hopkins | 52/36.5 |

FOREIGN PATENT DOCUMENTS

| | | | |
|---|---|---|---|
| GB | 2117813 | * | 3/1983 |
| WO | PCT/JP03/15875 | * | 6/2004 |

* cited by examiner

DISPLAY MOUNTING SYSTEM

CLAIM OF PRIORITY

This application claims the right of priority under 35 U.S.C. §119(*a*) to Australian patent application number 2005203620, filed on Aug. 12, 2005, the contents of which are incorporated herein by reference.

TECHNICAL FIELD

The invention relates to commercial display mounting systems, of the kind typically fitted by a specialist shopfitter. In particular, it relates to an improved construction for a panel which forms part of a display wall, and which provides a mounting for a cantilevered display support.

BACKGROUND OF THE INVENTION

Retailers and others who display goods commonly use demountable shelving and display supports for displaying those goods.

One requirement for commercial display systems is that they be versatile with respect to shelf or support positioning, in order to accommodate different types of displays and product lines. A commonly employed display system would be expected to include a plurality of cantilevered supports for shelving panels or the like, a display wall that features a plurality of display wall support mountings arranged in a suitable array, and a plurality of support brackets that can be inserted in selected ones of the mountings and which have a cantilevered arm that support the shelves or products at the display wall. The functional geometry of the interacting support mounting wall, with respect to strength, ease of installation and removal, and cost, are strong marketplace differentiators between the available systems.

A display mounting system of the above-described type, well known in the art in Australia is supplied by Australian Slatwall Industries Pty Ltd and is sold under the trademark SLATWALL. Problems inherent with this type of system, that will be familiar to those skilled in the art, include an inability to support heavy loads. These problems are described in more detail in Australian Patent Document No. 2004201505, the contents of which are incorporated herein by reference.

The above patent document further describes an improved shelving bracket mounting system and in particular describes an arcuate anchor portion for said cantilevered arms which has various benefits over the existing SLATWALL display mounting system, as well as a particular cavity profile for receiving said cantilevered arms which, in combination, provide a secure retention of the mount in the cavity having a very good strength and practical utility. The cavity profile described in the patent document provides a good level of support for the anchor portion which has a different profile to that of the cavity. A cavity which has an identical internal profile that is congruent or identical to the external profile of the anchor portion would provide improved support. That is, it would be most preferable to have a direct male-female correlation between the profiles of the anchor portion and cavity, i.e. a shape fit.

Unfortunately, the practical constraints of manufacture of shop fitting panels having grooves cut therein, whether they be constructed from extruded aluminum, craft wood or other material, mean that it would be expensive and somewhat difficult to reliably produce an exact groove of the type required in such panels.

It is an object of the present invention to provide panels for a display mounting system wherein an improved receiving cavity is provided for an arcuate anchor portion which of a display support bracket can be manufactured in a reliable and cost effective manner.

It is a further object of the invention to provide a system for mounting such panels to a shop wall which facilitates rapid installation of said panels and minimizes the appearance of screws, bolts or other fastening devices when installed.

SUMMARY OF THE INVENTION

According to one aspect of the invention, there is provided a display wall for a product display system, shelving brackets or similar items, said shelving brackets or similar items having a male anchor portion adapted to be received by an anchoring cavity, said wall being comprised of:

a. a plurality of interconnectable panels, each said panel having anterior and posterior surfaces and having upper and lower edge surfaces; each panel having upper and lower coupling projections, each extending from a posterior position at or near an upper and a lower traverse edge of the panel, respectively;

b. wherein said projections provide a complementary tongue and groove arrangement for assembly of a plurality of said panels into an upright wall;

c. characterized in that the upper projection has a first surface that extends from the upper traverse edge in a posterior direction and an upward manner away from an anterior surface of the panel, the lower projection has a second surface that extends from the lower traverse edge in a posterior direction and an upward manner away from the anterior surface of the panel, the first and second surfaces defining an anchoring cavity in an assembled state of two interconnected panels, in which can be received said male anchor portion of said brackets.

It will be understood by those skilled in the art that, while brackets for the support of shelves may be a major use for this invention, it may equally be applied to a variety of other related items such as hooks, coat rails or other specialized support or display items.

An advantage of the system described above is essentially that the cavity for receiving the anchor portion of the cantilevered support is formed at the junction of the two panels. This means it is not necessary to cut or extrude what may be an otherwise difficult profile into the front of the panel itself. Instead, the desired profile is partly formed at the lower edge of the upper panel, partly at the upper edge of the lower panel, and the cavity itself is formed by the bringing together of these upper and lower edges in adjacent, spaced-apart arrangement, when installed.

In addition, the ability to form the panel structure described above in a relatively rapid manner will allow the whole structure to be formed in a relatively rapid manner, saving labor costs attendant on installing such a shelving system.

A further advantage of such a system is that potentially only the relatively narrow opening of the cavity will be visible in the installed and assembled panel, promoting a better aesthetic in relation to the overall appearance of the panel.

This design facilitates the cost-effective mass production of standard said panels, in particular via aluminum extrusion.

Preferably, said anchoring cavity is adapted to receive an anchor portion having a profile which is an upwardly curved tab of substantially even thickness; in particular having a curved profile of a substantially constant radius of curvature, and advantageously wherein said curve extends though a substantially circular segment of approximately 90°, in order to fully exploit the advantages of the anchor portion identified in Australian Patent Document No 2004201505, discussed above.

In one embodiment, the profile of said cavity is upwardly curved away from said anterior surface and is of substantially even height, in order to match the profile of the preferred anchor portion of the above described anchor portion. Another embodiment of the anchor portion and corresponding cavity is achieved where said curved profile is of a substantially constant radius of curvature. This allows considerable ease of installation and removal of said anchor portion. In a disclosed embodiment said curve extends through a substantially circular segment of approximately 90°.

An embodiment of the posterior projections of the upper and lower panels occurs wherein the coupling projection extending from the upper surface of said panel includes, in profile, a male tang, and wherein the coupling projection extending from the lower surface of said panel includes, in profile, a female cavity adapted to make resilient engagement with said tang.

This arrangement has been found to be relatively simple to install, while providing the requisite strength for the support of the composite structure of which the panels form part.

In an embodiment of the mounting system described above, the coupling projection extending from the upper surface of said panel includes, in profile, one inner and one outer upwardly curved male tangs sharing substantially the same center of curvature, and wherein the coupling projection extending from the lower surface of said panel includes, in profile, a female cavity adapted to receive said inner tang; and wherein said outer tang is adapted to make engagement with an outer surface of an identical said coupling projection extending from said lower surface.

This embodiment provides great ease of installation and dismantling, as the structure allows a simple pivoting movement to engage the upper and lower panels and to maneuver them into position.

Said outer surface of said coupling projection extending from said lower surface features a convex curvature which substantially shares center of curvature with said outer tang.

In a disclosed embodiment, the end of said outer tang features a detent notch adapted to make resilient engagement with a complementary detent depression in an upper portion of said coupling projection extending from said lower panel. The complementary notch and depression enhances the ability of the panels to make resilient engagement with one another.

According to another aspect of the invention, there is provided a modular display system, including a plurality of panels, according to those defined above, and a plurality of removable cantilevered support brackets mountable to said wall at selectable anchoring locations, wherein the support brackets have a terminal male anchor portion adapted to be received in said anchoring cavity formed by the interlocking connection of said panels, according to those defined above.

As will be discussed below, in one embodiment the posterior surface of said panels features two or more secondary posterior projections which are adapted to receive a positioning lug in the channel formed therebetween. Such an embodiment will allow the construction of a system for securing the above described mounting system to a wall, said system including:

a. two or more vertical support members arranged in a secure manner adjacent said wall, said members featuring channels adapted to receive a lug anchor, said channels being open toward the anterior side of said support member;

b. one or more lug anchors being received within said channels, said anchors having a width dimension greater than the width of a main portion of said channel opening, such that said anchors may move freely within said channel but may not pass through said channel opening; and c. positioning lugs connected to said lug anchors and extending therefrom through said channel opening;

d. wherein said lugs are inserted between said secondary posterior projections of said panels in order to make resilient connection with said panels.

One advantage of this system is that the panels may be installed easily manually by simply positioning the channel formed by the secondary projections in front of the lug, and pushing the channel onto the lug.

Another advantage is that the vertical positioning of the anchor-receiving channel is thereby made flexible, due to the fact that the lug anchor may be moved freely within the channel in the vertical support member, and thereby is enabled to engage with the panel at any height. The height at which the anchor receiving channel occurs is determined by the height and number of the panels which vertically support it from below.

In a disclosed embodiment, the lugs feature barb-like projections on their outer surface, said projections being arranged to engage with similar projections on the facing surfaces of said secondary posterior projections to effect said resilient connection, thereby forming a more secure installation of the panels. In a disclosed embodiment, the lugs are made from steel.

An embodiment of the vertical support members is provided wherein said channel opening is, at predetermined positions, wider than the width of said lug anchors to allow said lug anchors to be inserted into said channel. This facilitates rapid installation of the overall system, in that the lug anchors may be inserted or removed.

According to another aspect of the invention, there is provided a mounting system for shelving brackets or similar items, said shelving brackets or similar items having a male anchor portion adapted to be received by an anchoring cavity, said system including at least one panel having an anterior face and a posterior face, said panel adapted to receive an anchor portion having a profile which is an upwardly curved tab of substantially even thickness via a cavity located in said anterior face, wherein said cavity is a horizontally oriented slot which has a profile substantially matching the profile of said anchor portion, featuring an upwardly curved portion of substantially even height, and wherein said slot is present in an insert which is received by said panel, said insert preferably being a length of extruded metal, such as aluminum.

An advantage of such a system, as compared with the prior art, is that the matching of the profile of the cavity to the anchor portion is that the anchor portion may be supported along it's entire length, rather than at specific points, which increases the stability of the anchor portion. Another advantage is that the use of an insert to provide the required cavity allows the above advantageous cavity to be installed reliably in a variety of materials.

These and other objects, features, and advantages of the present invention may be more clearly understood and appreciated from a review of ensuing detailed description of the preferred and alternate embodiments and by reference to the accompanying drawings and claims.

Now will be described, by way of a specific, non-limiting example, a preferred embodiment of the invention.

DETAILED DESCRIPTION OF THE DISCLOSED EMBODIMENTS

While the present invention will be described more fully hereinafter with reference to the accompanying drawings, in which various embodiments of the present invention are shown, it is to be understood at the outset of the description which follows that persons of skill in the appropriate arts may modify the invention herein described while still achieving the favorable results of this invention. Accordingly, the description which follows is to be understood as being a broad, teaching disclosure directed to persons of skill in the appropriate arts, and not as limiting upon the present invention.

Figure 1:
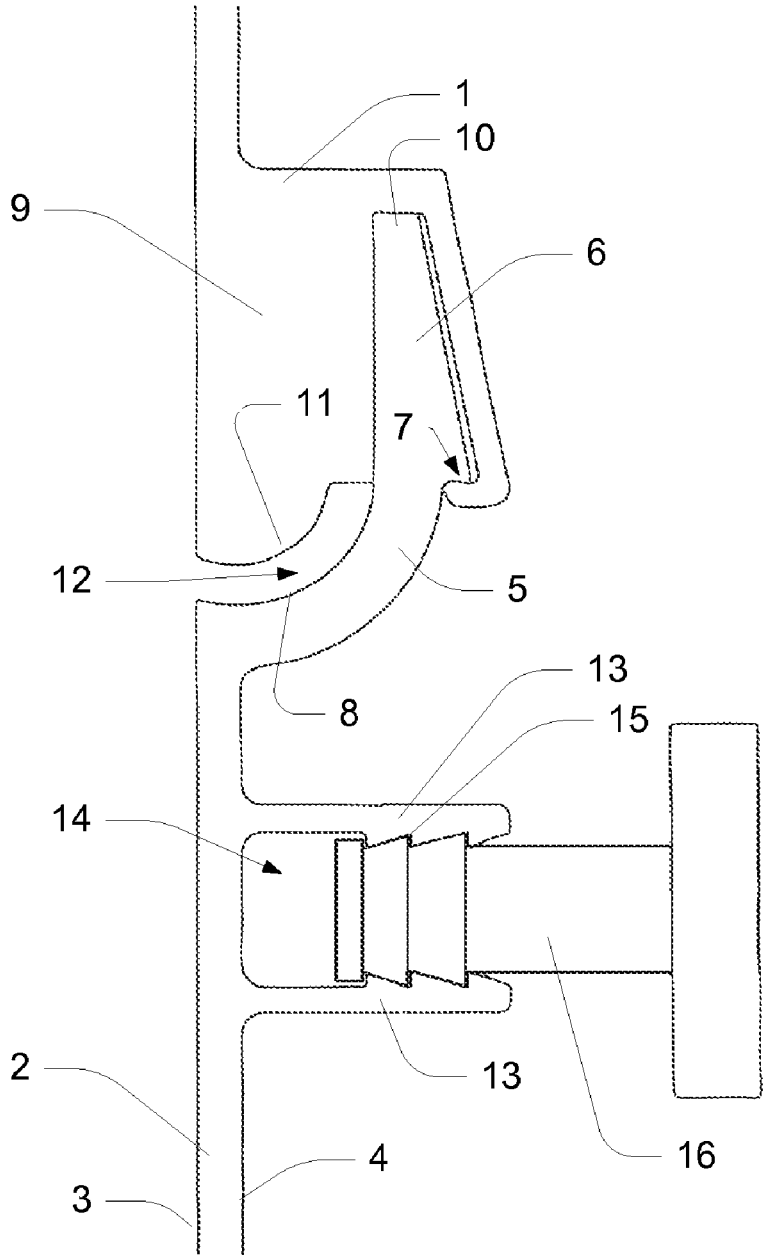
FIG. 1 depicts a profile view of a junction of two panel sections according to the invention.

Turning first to FIG. 1, there is shown a schematic profile of a junction of an upper panel 1 and a lower panel 2 according to an embodiment of the invention. The panels are shown to have anterior, or front, surfaces 3 and posterior or rear surfaces 4. The lower panel 2 features an upwardly curved portion 5 which is adapted to engage with the upper panel 1. This curved portion 5 features a male protrusion 6, further featuring an engaging notch 7. The upper surface 8 of this curved portion 5 features a curvature which is designed to directly engage with the underside surface of an anchor portion of a shelving bracket (not shown).

The lower end of the upper panel 1 also features a rearwardly protruding member 9 which defines a female cavity 10 for receiving the upwardly curving portion 5 described above. The lower edge of the upper panel 1 also defines an upwardly curved surface 11, which is adapted to engage with an upper surface of an anchor portion of a shelving bracket (not shown).

According to the invention, the upper edge (not shown) of the upper panel 1 features a profile identical to the upper edge of the lower panel 2. Equally, the lower edge (not shown) of the lower panel 2 features a profile identical to the lower edge of the upper panel 1.

It will further be apparent in FIG. 1 the manner in which the male engaging portion 6 of the lower panel 2 interlocks with the female cavity 10 featured at the lower portion of the upper panel 1. It will further be noted that the curved cavity 12 which is formed between the upper and lower panels is formed by the engagement of these two panels and is adapted to receive a curved anchor portion of a shelving support bracket (not shown).

Both of the panels (although not shown in the upper panel 1) also feature two rearwardly protruding projections 13, which extend substantially across the width of the panels. A cavity (in the form of a channel) 14 is formed between said projections. The inner walls 15 of said channel 14 feature a barbed profile. This profile is adapted to receive an anchoring lug 16 for installation of the panels in a paneling system.

Figure 2:
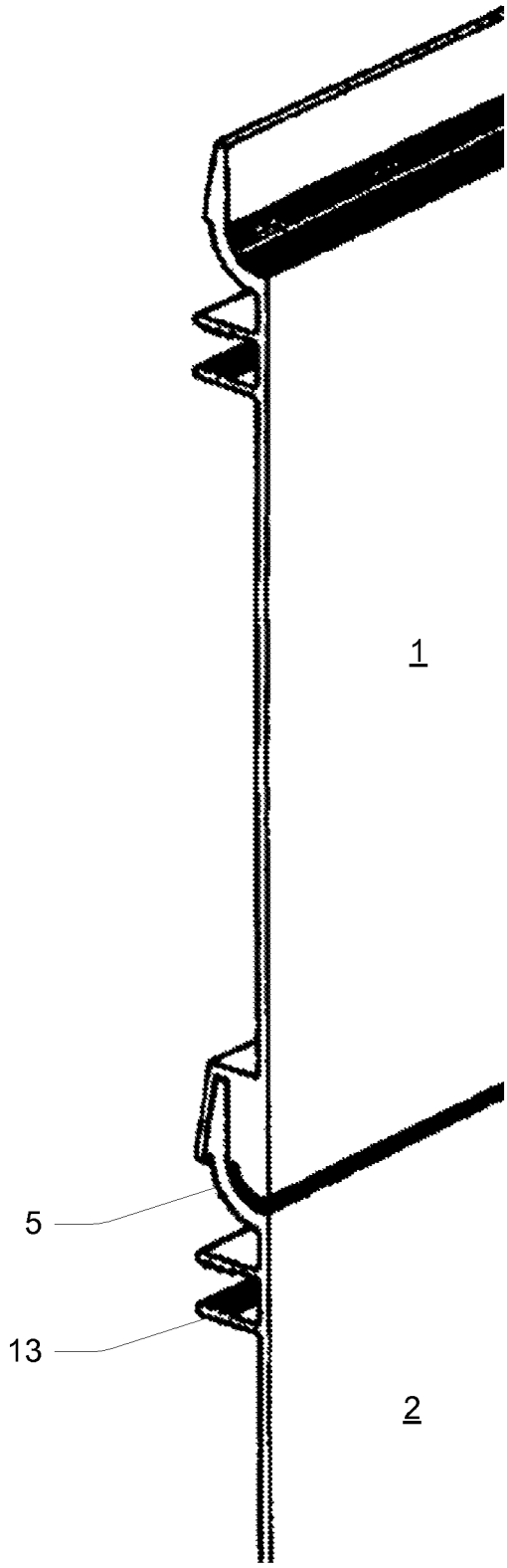
FIG. 2 depicts two panels according to the invention interlocked in a manner also according to the invention.

Turning now to FIG. 2, there is shown the upper panel 1 and lower panel in interlocking engagement.

Figure 3:
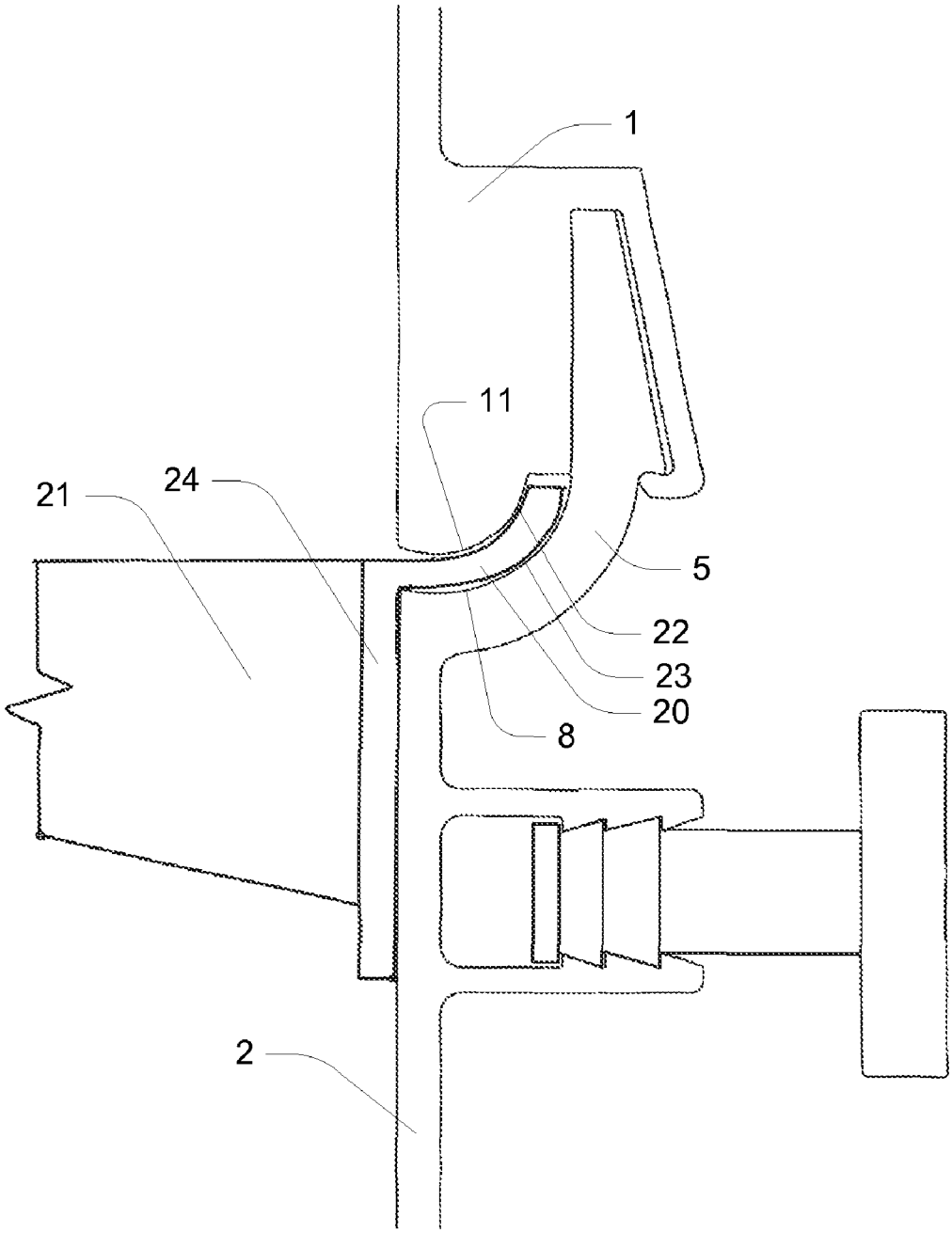
FIG. 3 depicts the junction between two of said panels according to the invention, forming a cavity therebetween and into which an anchor portion of a shelving support bracket has been inserted.

Turning now to FIG. 3, there is shown a junction between an upper panel 1 and a lower panel 2 of the type described above, thereby forming said cavity 12, and into which the anchor portion 20 of a shelving support bracket 21 (not shown in entirety) has been inserted. It will be appreciated that the shelving support bracket 21 is thereby effectively held in place on the "wall" formed by the interlocking panels by the interaction between the anchor portion 20 and the upper and lower panels, wherein the anchor portion 20 fits snugly inside said cavity 12 due to the curvature of the upper surface 8 of the curved portion 5 of the lower panel 2 and the curvature of the lower edge 11 of the upper panel 1 (which have been chosen to match the curvature of the anchor portion 20), and can only be removed by an upward pivoting of said bracket 21.

Thus the upper curved surface 22 of the anchor portion 20 interacts with the upper internal curved surface 11 of the cavity 12 in particular to prevent the anchor portion 20 being withdrawn in a horizontal direction from the cavity 20. The lower curved surface 23 of the anchor portion 20 rests on the lower curved surface of the cavity 8 to prevent downward movement of the shelving support bracket 21 and the back plate 24 of the shelving support bracket 20 presses on the front surface 3 of the lower panel 2 to prevent a downwards rotation in a clockwise direction (as shown) of the support bracket 21 relative to the anchor portion 20 as illustrated.

Figure 4:
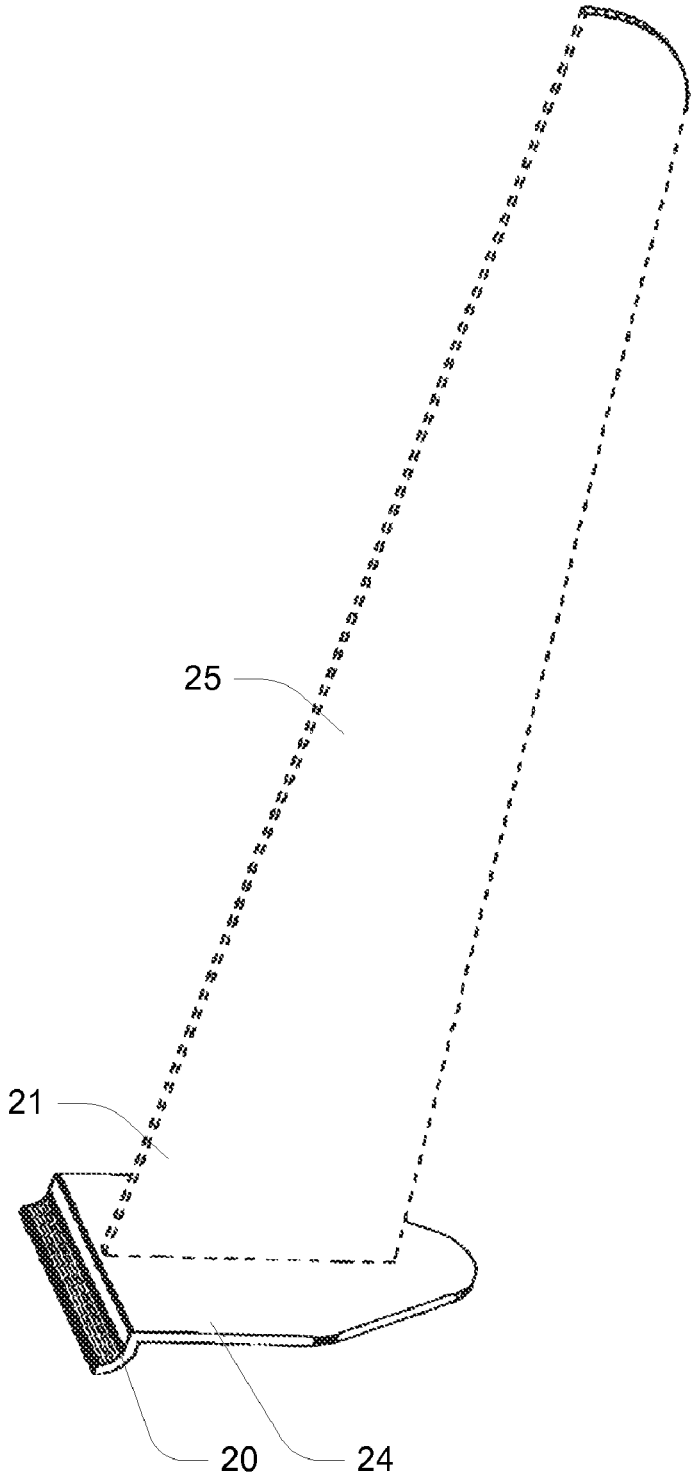
FIG. 4 depicts a shelving support bracket according to the invention.
Figure 5:
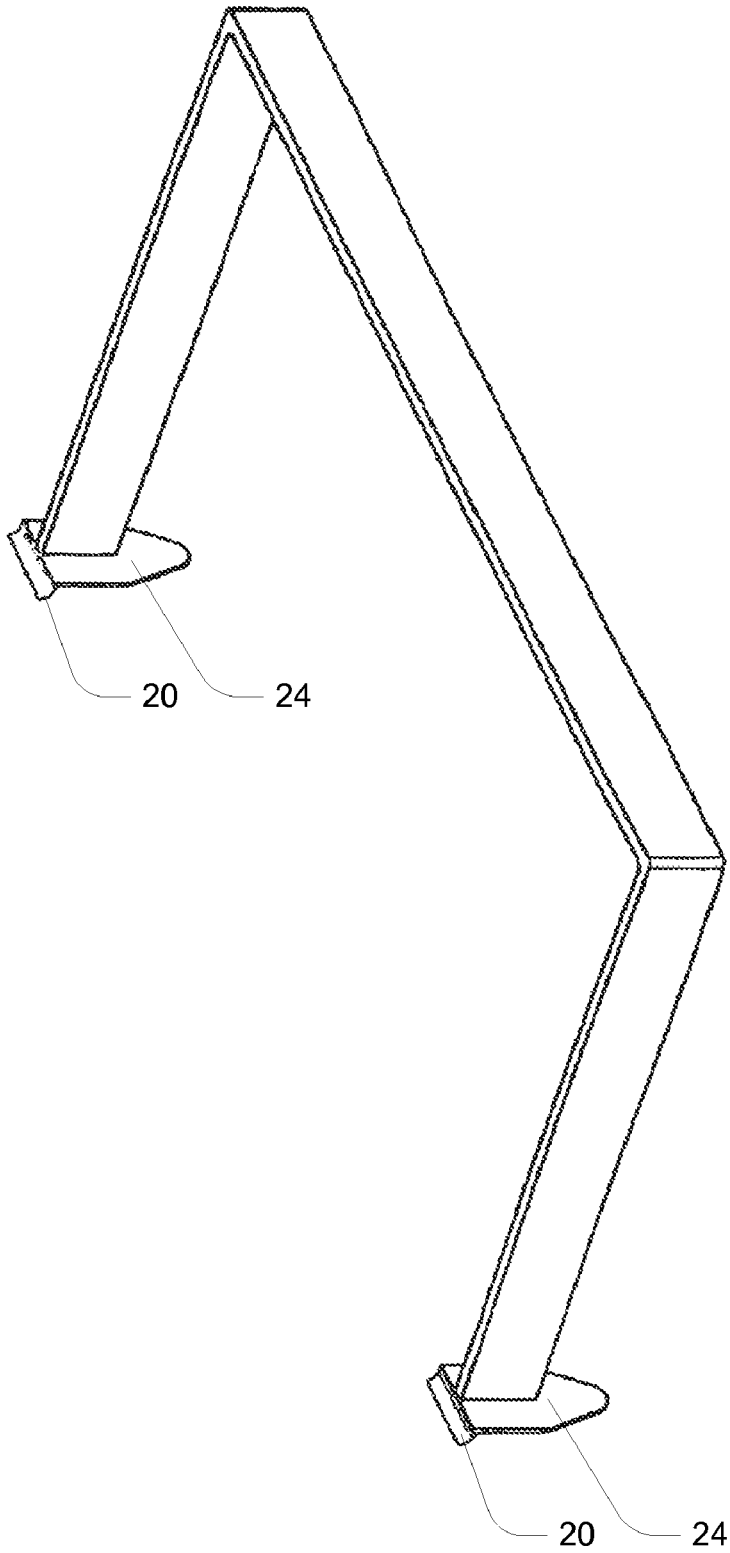
FIG. 5 depicts a coat rack according to the invention.
Figure 6:
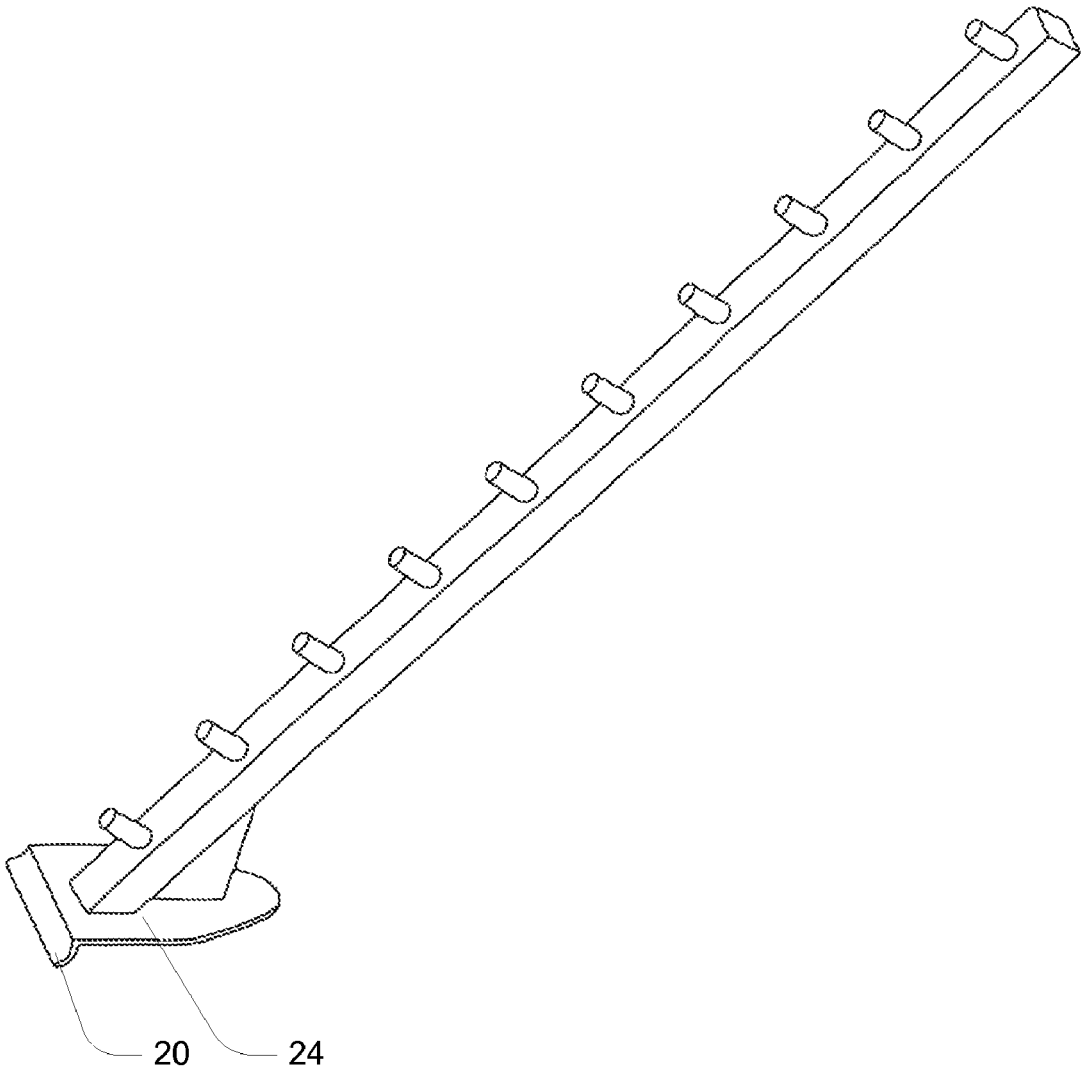
FIG. 6 represents an alternative coat rack according to the invention.
Figure 7:
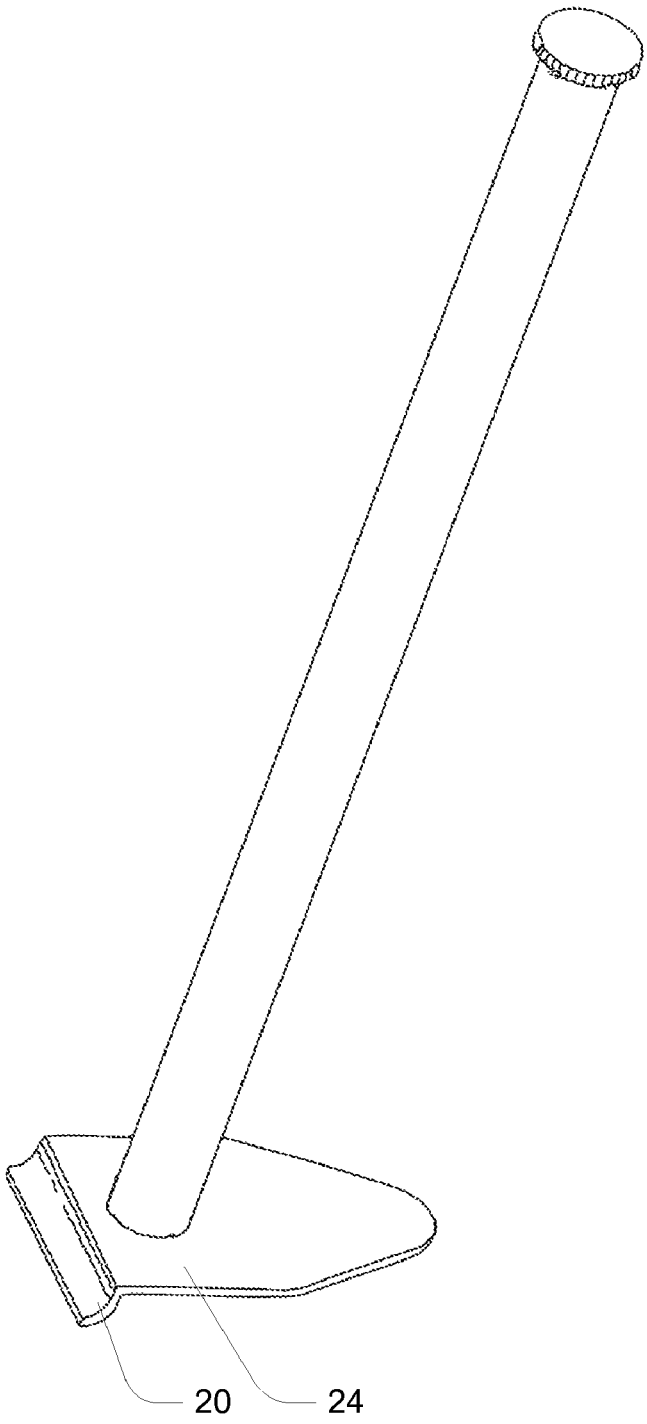
FIG. 7 depicts an alternative coat rack according to the invention.
Figure 8:
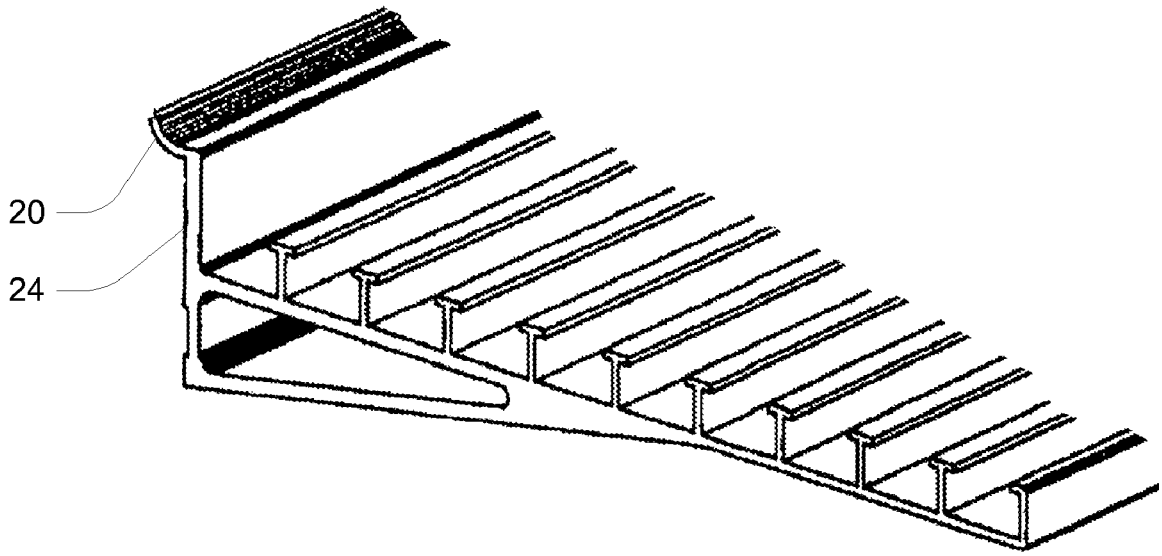
FIG. 8 depicts a compact disc display shelf according to the invention.
Figure 9:
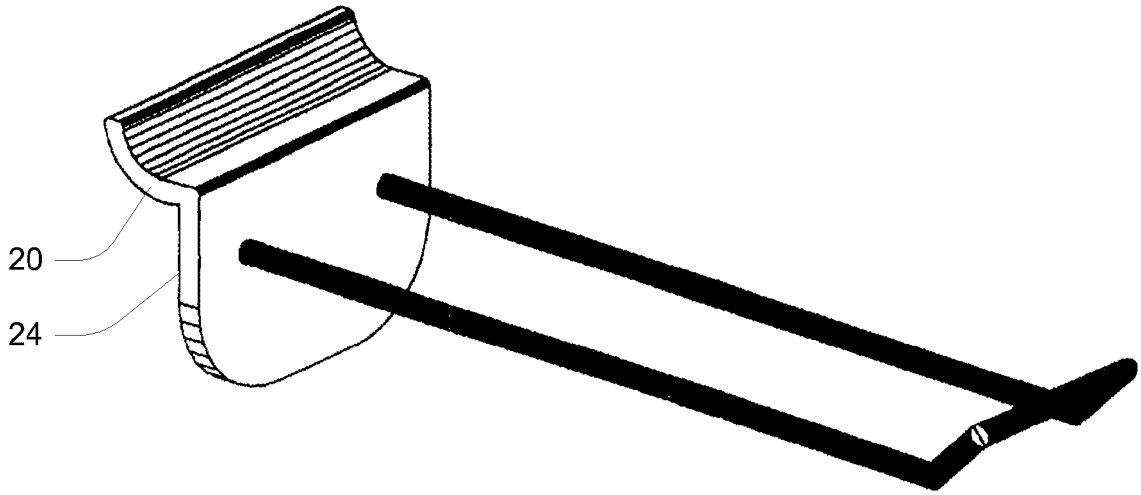
FIG. 9 depicts a display hook according to the invention.

FIG. 4 shows an archetypal shelving support bracket 21 of the kind which may be used in conjunction with the present invention. The curved anchor portion 20 is illustrated attached to a horizontal plate 24. To the horizontal plate 24 is appended a cantilever member 25 adapted to support a shelf. It will be noted, via the rendering of the shelf support cantilever member 25 in dotted lines, that many other structures, designed for many other purposes, may equally be appended to the vertical plate of the cantilever member. FIGS. 5, 6, 7, 8 and 9 illustrate a number of examples of support brackets for various purposes, including hanging racks of different types and, particularly in FIG. 8, a rack designed for holding compact disc cases.

Figure 10:
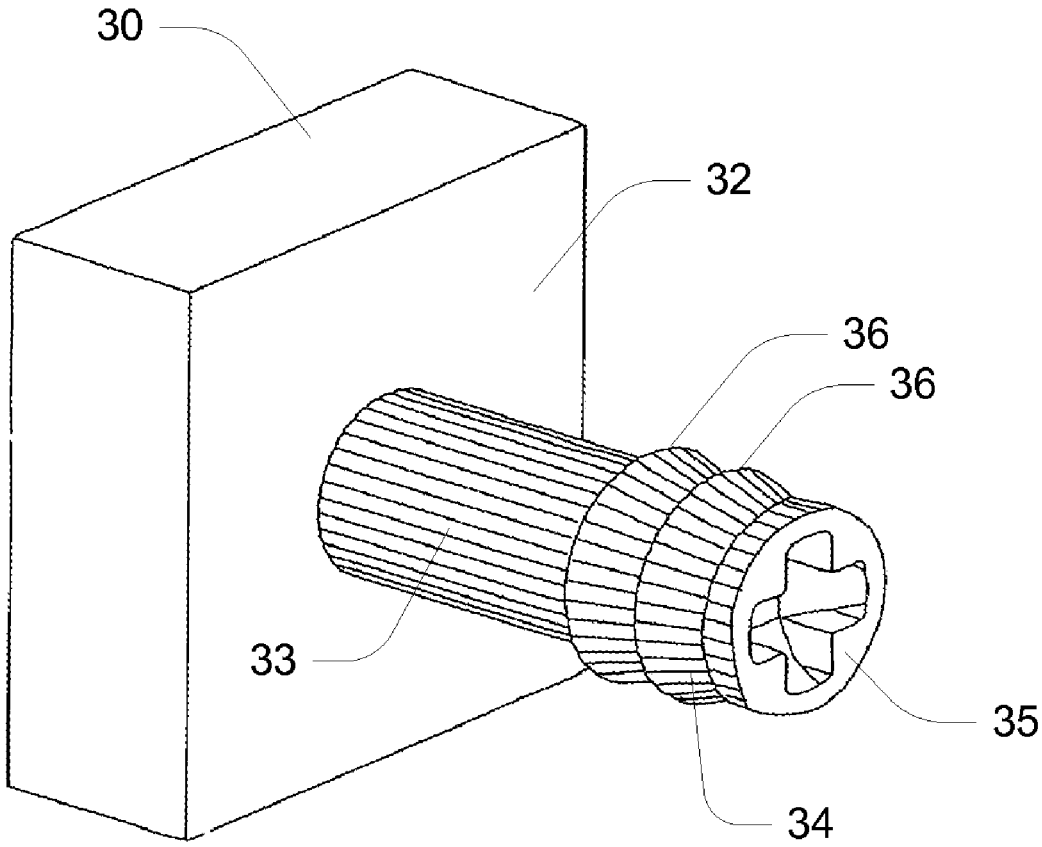
FIG. 10 depicts a positioning lug and lug anchor according to the invention.

Turning to FIG. 10, there is illustrated a lug anchor 30 and positioning lug 31 which are adapted to be used in accordance with the system for securing the mounting system to a wall, according with an embodiment of the present invention. The lug anchor consists of an aluminum block 32 into which the positioning lug 31 may be screwed or otherwise firmly affixed. The positioning lug 31 consists of a barrel portion 33, a barb portion 34 and a screwdriver-engaging portion 35. As illustrated, the barrel portion 33 connects that barb portion 34 to the lug anchor 30. The barb portion 34 consists of two conical protrusions 36 which are adapted to allow the easy insertion of the lug into the channel 14 formed by the posterior projections 13 to the panel 2 as described above. The positioning lugs are shaped to interact with the internal barbs 15 on the channel 14 as illustrated in FIG. 1. This physical arrangement allows the panels to be securely fixed in position via interaction with the lugs.

The screwdriver-engaging portion 35, in this particular embodiment illustrated as a Phillips-head screwdriver engaging portion, allows the lug 31 to be screwed directly into the block 32.

Figure 11:
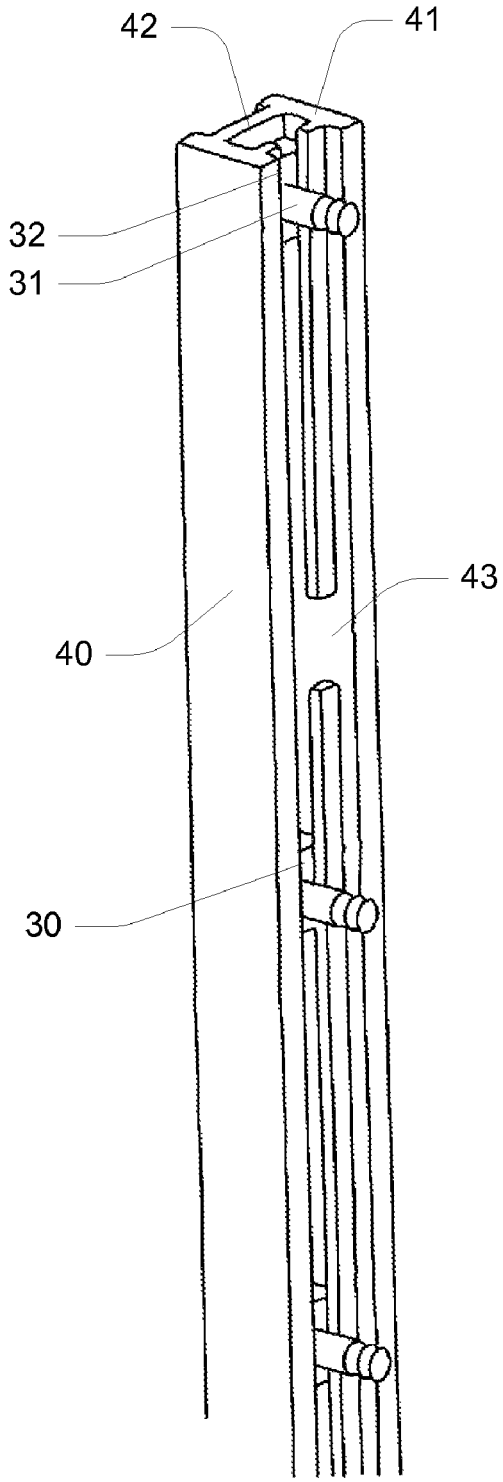
FIG. 11 depicts various lug anchors inserted in a vertical member according to the invention.

Turning now to FIG. 11, there is a shown a vertical support member 40 for a shelving support system according to an embodiment of the invention. The support member as illustrated consists of an extruded aluminum beam 41, said beam featuring an overall "C-shape" profile. This profile provides an internal channel 42 of dimensions similar to the size of the block 32 which forms part of the lug anchor 30 as described above. This channel 42 is adapted thereby to receive the block 32 of the lug anchor 30 as illustrated. The gap in the channel has a width adapted to allow the barrel portion 31 of the positioning lug to protrude therethrough, in order to engage with the panels which comprise part of the system.

During installation, the installer can slide the lug anchor 32 down the channel 42 until it has reached the desired position to attach to the panels. It will be noted that in this embodiment the lug anchor 32 is sized so as to allow free movement of the lug anchor in the receiving channel 42. This allows considerable flexibility when installing panels of differing heights.

In an embodiment illustrated in FIG. 11, at least one further opening 43 is provided to the channel 42 which is sized to allow the insertion of the entire lug anchor at an intermediate point along the channel 42, rather than exclusively at the end of the channel 42. This provides the installer with additional flexibility, especially when working with longer versions of the support member 40, as regards the position in which the lug anchors 32 are inserted.

Figure 12:
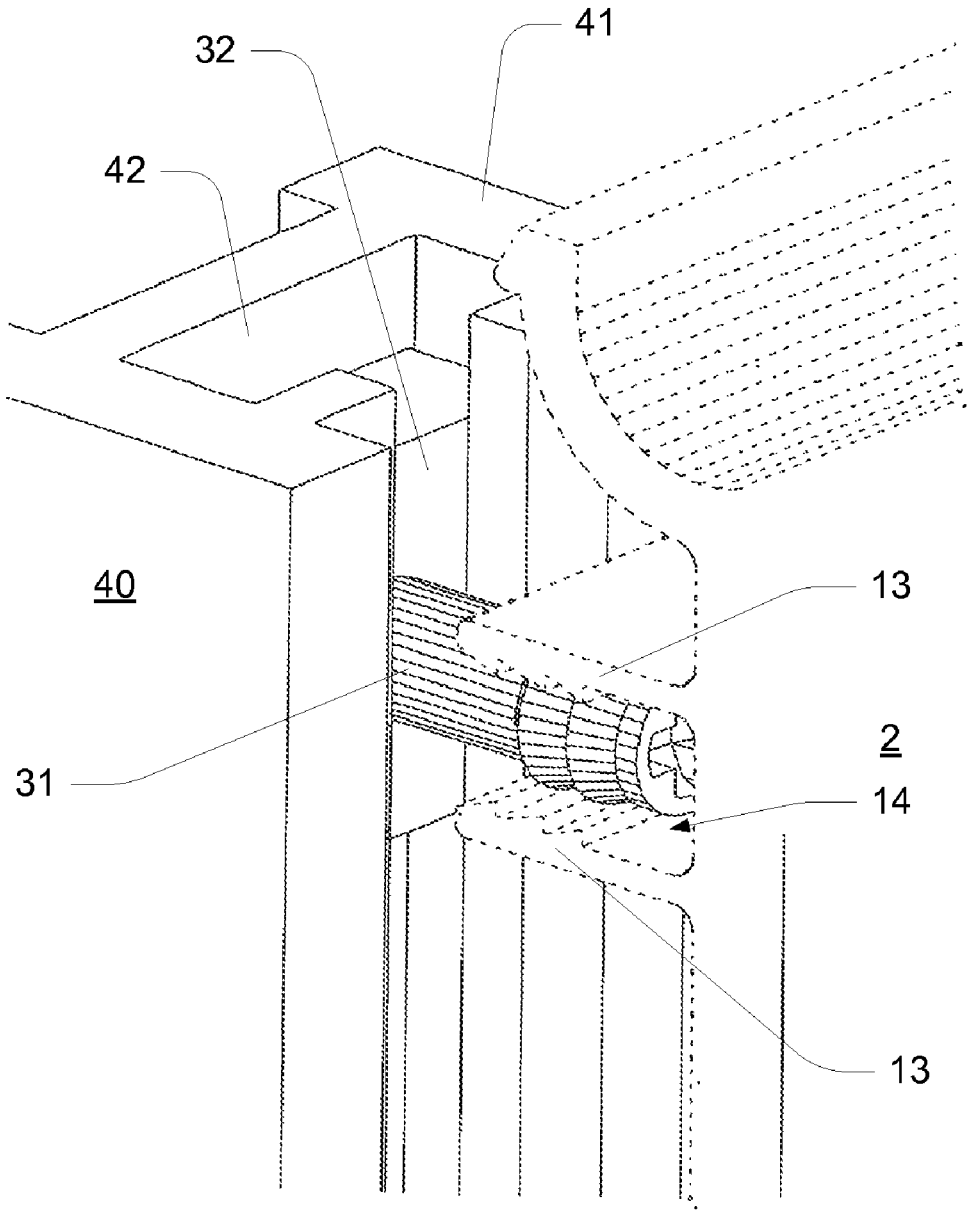
FIG. 12 depicts a panel according to the invention connected to a positioning lug which is located in a vertical support member according to the invention.

Turning now to FIG. 12, there is shown a lug anchor 32 inserted in the channel 42 formed by the vertical support member 40, and wherein a positioning lug 31 is shown protruding through the gap in said channel 42. In addition, shown in dotted lines, is the prospective position of a panel according to the invention. The positioning lug 31 has been inserted in between the rearward protrusions 13 to the panel 2, and has been received in a resilient manner inside the channel 14 formed between said protrusions. In this manner, the panels are attached to the support member during installation.

Figure 13:
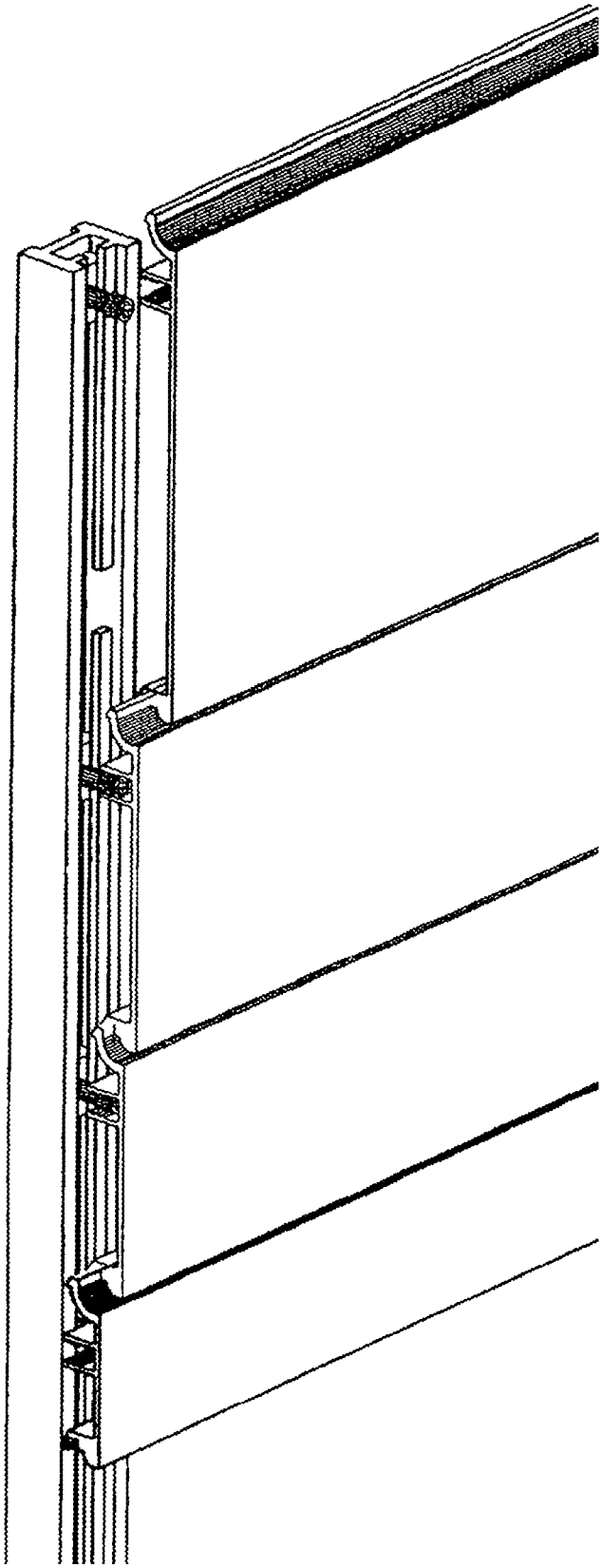
FIG. 13 depicts four interlocking panels according to the invention positioned adjacent a vertical support member and connected to same via position lugs.

Turning now to FIG. 13, there is shown a number of panels installed in an interlocking manner and connected to a vertical support member 40 in the manner described above. In this particular illustration, it will be noted that the panels are in fact slightly offset from their proper installed position, in order to illustrate the relative positioning of the panels and the positioning lugs 31.

It will also be noted that the 'wall' provided by the formation of the panels may be constructed of any number of separate interlocking panels. The panels may also be of varying heights, depending on the desired positioning of the shelf support inserts of the shelving system.

In an embodiment of the invention all of components discussed above are constructed from extruded aluminum. This material is light and strong and the shapes of most of the components discussed above, in particular the panels and the vertical support member have been designed to facilitate their manufacture by this method. In particular, where the components are manufactured as aluminum extrusions, they may be produced relatively cheaply and can be delivered at precise dimensional tolerances. In addition, aluminum provides an ideal substrate for a variety of coatings and finishes. It will be understood, however, that other materials are also suitable for the present invention.

Figure 14:
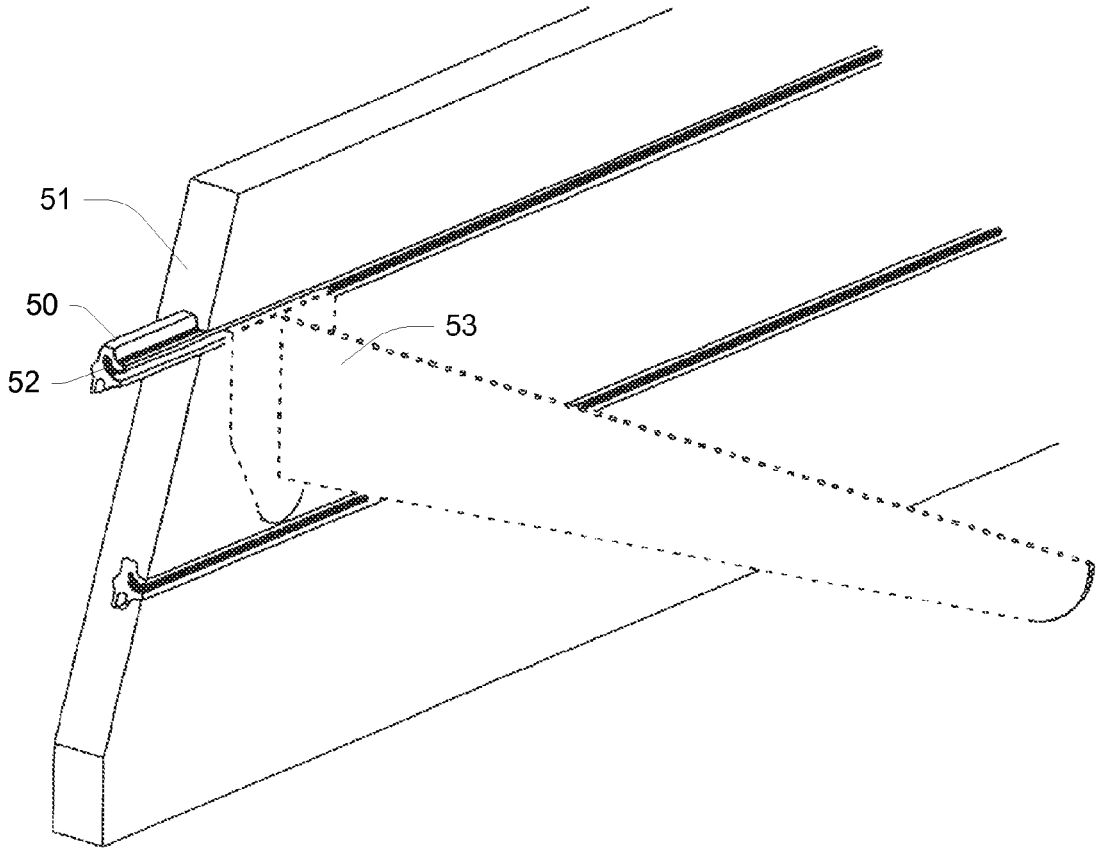
FIG. 14 depicts a wall panel made from wood material, with aluminum inserts designed to receive an anchor portion of a shelving support bracket.

Turning to FIG. 14, there is shown an alternative embodiment of the invention in its broadest form. In this embodiment, suitable for applications where aluminum may not provide the optimum aesthetic finish, an extruded aluminum insert 50 is placed in an panel 51 made from another material, such as wood. The insert features a female cavity 52 which is adapted to receive the anchor portion of a shelving support bracket 53 (shown in dotted lines).

Figure 15:
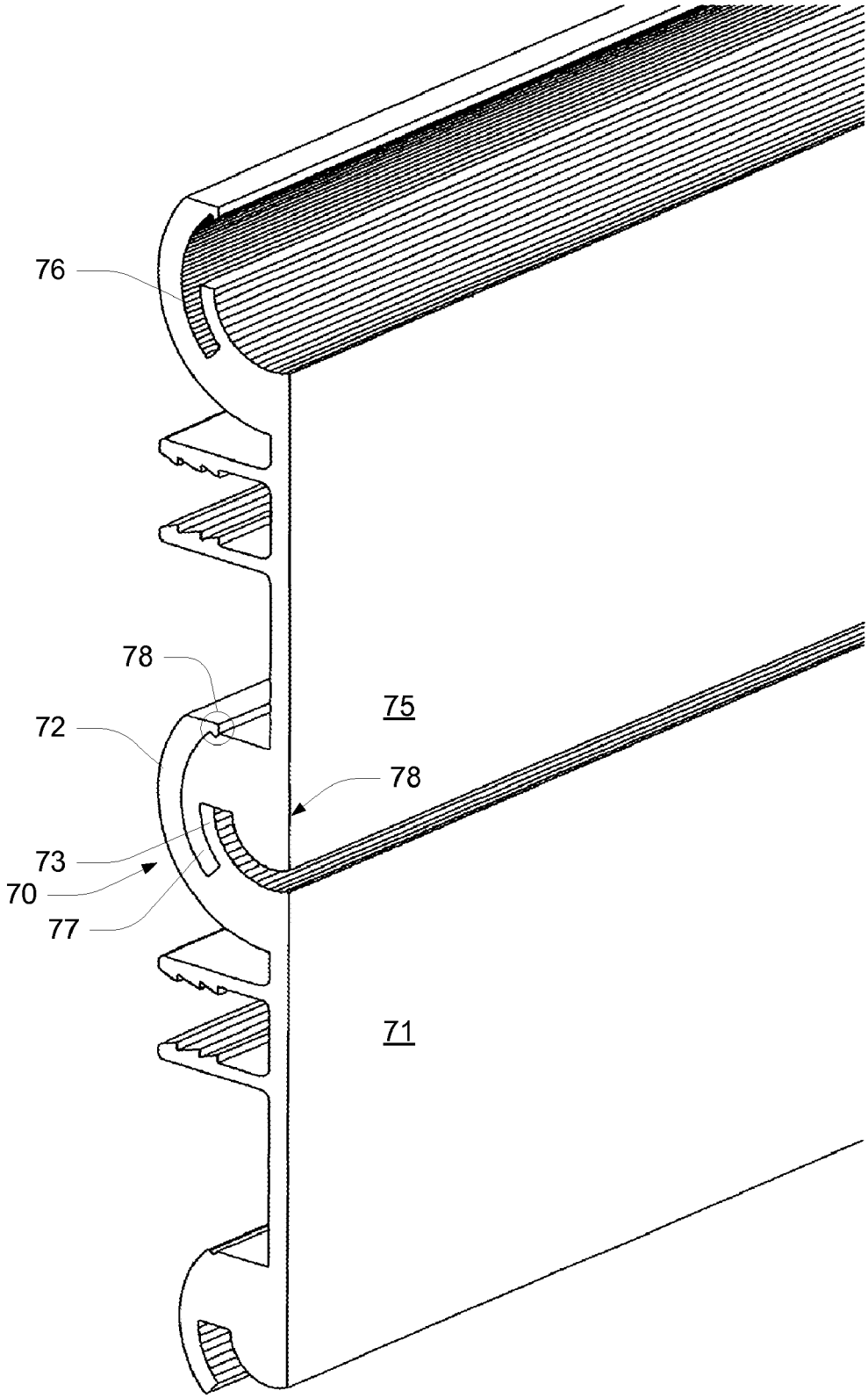
FIG. 15 depicts an orthogonal view of an alternative embodiment of the panels of a shelving system according to the invention.
Figure 16:
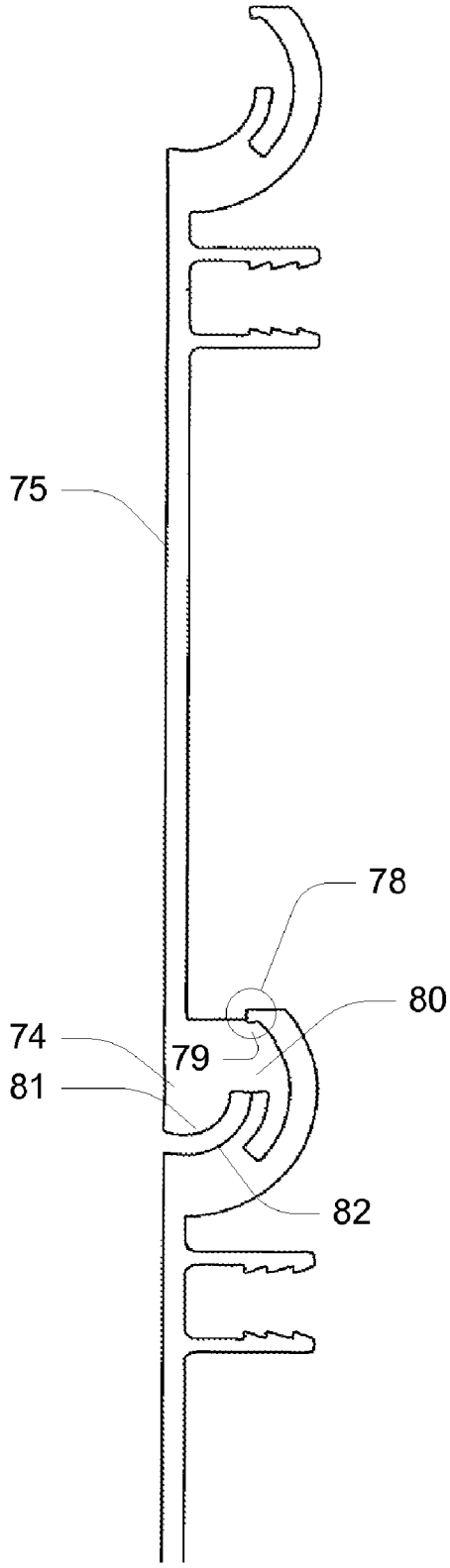
FIG. 16 depicts a side view of the system of FIG. 15.
Figure 17:
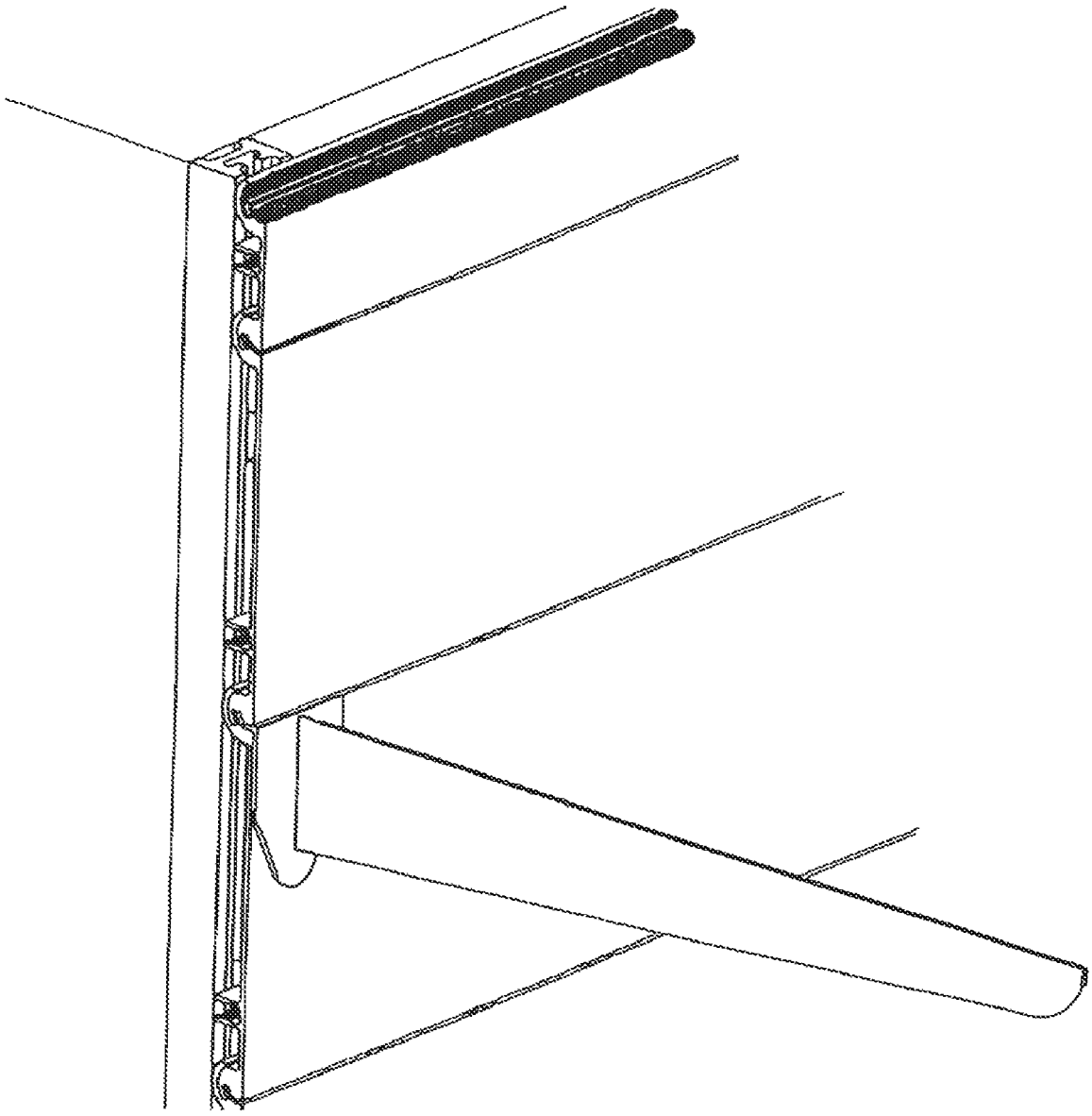
FIG. 17 depicts the junction between two of the panels of FIG. 15, forming a cavity therebetween and into which an anchor portion of a shelving support bracket has been inserted.

Turning to FIGS. 15, 16, and 17, there is shown another embodiment of the invention featuring an alternative geometry of the upper and lower edge surfaces. In particular, it will be noted that the upper edge 70 of the relatively lower panel 71 features two upwardly curved portions (72,73) which are adapted to engage with the lower edge surface 74 of the relatively upper panel 75: an inner portion 73 and an outer portion 72 which define between them a channel 76 adapted to receive a complementary downwardly curved portion 77 of the lower surface 74 of the relatively upper panel 75 when said panels are in engagement.

It will also be noted that the outer upwardly curved portion 72 features an engaging notch 78 which is adapted to engage the shoulder 79 of the rearwardly projecting part 80 of the lower edge 74 of the relatively upper panel 75 to effect locking into relative positions of the panels.

It will further be noted that center of curvature of said upwardly curved portions (72, 73), as well as said downwardly curved portion, coincide with the center of curvature of one another and with the upper and lower surfaces (81, 82) adapted to engage with the anchor portion of the shelving support bracket.

As further shown in FIGS. 15 and 16, each interconnectable panel in a display wall includes an extruded aluminum section comprising a central web having an integral terminal enlargement along each of the upper and lower longitudinal edges. The upper enlargement, defining the upper edge 70, is both curved and bifurcated to define a similarly curved and concentric inner finger 73 and outer finger 72, between which fingers are located a curved channel 76. The outer finger is longer than the inner finger. The uppermost extent of the outer finger further comprises a downward facing engaging notch 78. Accordingly, a gap is formed between the notch and the uppermost extent of the inner finger 73. This gap forms a throat or entry into the downward extending closed ended channel 76 that is located between the fingers 72, 73. The gap or throat between the free ends of the fingers 72, 73 is adapted to receive a portion of the lower enlargement 80, which enlargement 80 extends rearwardly. The lower enlargement 80 is bifurcated by a longitudinal groove to form the downwardly curved intermediate finger 77 that conforms in shape and length to cooperate with and enter the longitudinal channel 76.

The panels are engaged by interdigitating them in rotation. When engaged, the top surface 82 of the inner finger 73 and the bottom surface 81 of the lower enlargement 80 form a curved longitudinal anchor slot that is curved in the same way as the fingers 72, 73. The anchor slot preferably has a constant radius so as to engage brackets with a radiused anchor portion 20 as shown in FIG. 4. The upper surface of the anchor slot is formed by the radiused lowered surface of the lower enlargement of the upper panel. The anchor slot thus formed is an arc having a common concentric curvature as the inner and outer fingers 72, 73, the channel 76 and the finger 77. Note that the free length of the inner finger 73 is about the same length as the length of the intermediate finger 77. An upper surface of the lower enlargement further comprises a longitudinal shoulder 79 for receiving the engagement notch 78. Thus, the uppermost extent of a lower panel extends above but engages with the shoulder on the uppermost surface of a lower enlargement 80 of a panel that is adjacent to and above it. As best shown in FIG. 16, the intermediate finger 77, within the context of a sliding interdigitating fit required for assembly, occupies practically the entirety of the channel 76 formed between the bifurcations 72, 73. Further, the lower extremity of the intermediate finger 77 reaches, for practical purposes, the terminal or closed end of the channel 76. Because the inner and outer fingers 72, 73, the channel 76, and the intermediate finger 77 have a cooperating concentric curved configuration when assembled, the adjacent panels engage and disengage with one another by rotation relative to one another.

Figure 18:
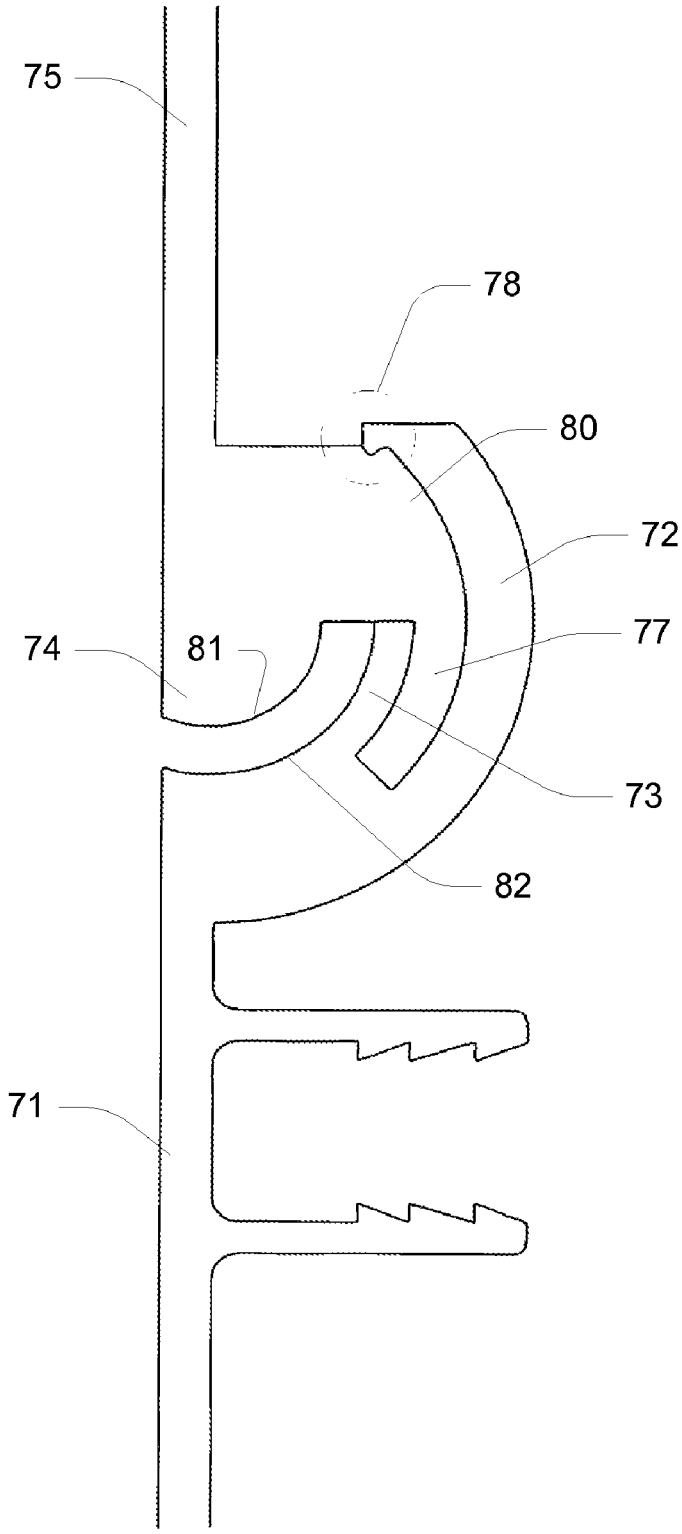
FIG. 18 depicts a particularly advantageous embodiment of the panels of FIG. 15.

FIG. 18 shows a version of the alternative embodiment depicted in FIGS. 15, 16 and 17, with respect to particular dimensions.

The embodiment depicted in FIGS. 15, 16 and 17 has advantages, in that it is easier to install, by virtue of being able to insert the lower edge of an upper panel into the upper edge of an already installed lower panel by presenting the upper panel in a relatively perpendicular orientation, and causing the above described engagement structures to engage in the manner described by tilting the upper panel into an upright position parallel to the lower panel.

This embodiment equally allows an easier method of disassembly of the paneling structure by the reverse of the above described procedure.

It will be understood by those skilled in the art that the inventive components and system described above may be manufactured from various different materials and in a number of variations in the precise shape of the parts, which will nevertheless fall within the spirit and scope of the invention.

Accordingly, it will be understood that the above embodiment of the present invention have been disclosed by way of example and that other modifications and alterations may occur to those skilled in the art without departing from the scope and spirit of the appended claims.

What is claimed is:

1. A display system including a plurality of panels that are interconnectable to form a wall having an elongated anchor slot between any two adjacent panels for receiving a support bracket with a curved anchor portion, each panel comprising:

an extruded section comprising a central web having an upper enlargement defining an upper longitudinal edge and a lower enlargement defining a lower longitudinal edge;

the upper enlargement being bifurcated by a curved channel to define a curved inner finger and a curved outer finger, the outer finger being concentric with the inner finger;

a throat formed between an upper extent of the outer finger and an upper extent of the inner finger, the throat adapted to receive a portion of said lower enlargement of an adjacent one of the plurality of panels;

the lower enlargement comprising a curved intermediate finger adapted to be received within said curved channel of an adjacent one of the plurality of panels;

wherein the anchor slot defines an anchoring cavity formed by respective surfaces of the upper and lower enlargement of any two interconnected panels of the plurality of panels, said anchoring cavity having a curved profile having a substantially constant radius of curvature; the anchoring cavity having a common concentric curvature as the respective inner finger; the anchoring cavity being further adapted to receive an anchor portion of a support bracket having a profile which is a curved tab of substantially even thickness; and the anchoring cavity having along its curved profile a substantially uniform distance between the surfaces of the respective upper and lower enlargements of any two interconnected panels for receiving the curved tab.

2. The display wall of claim 1, wherein the profile of the anchoring cavity describes an upward curve away from the anterior side of the panels.

3. The display wall of claim 1, wherein the curved profile of the anchoring cavity extends through a substantially circular segment of approximately 90° .

4. The display wall of claim 1, wherein a posterior surface of each of the panels further includes a plurality of secondary posterior projections adapted to receive positioning lugs there between.

5. The display system according to claim 1, wherein adjacent panels engage and disengage with one another by rotation relative to one another.

6. The display system according to claim 1, wherein the outer finger being longer than the inner finger, and an upper extent of the outer finger comprising an engaging notch.

7. The display system according to claim 1, wherein the throat is formed between an engaging notch and an upper extent of the inner finger,

8. The display system according to claim 1, wherein the anchoring cavity is adapted to receive the curved anchor portion of the support bracket for releasablly retaining the support bracket.

9. The display system according to claim 1, wherein the extruded section is an extruded metal section.

10. The display system according to claim 1, wherein the extruded section is an extruded aluminum section.

* * * * *